US010362912B2

(12) United States Patent
Hyun et al.

(10) Patent No.: US 10,362,912 B2
(45) Date of Patent: Jul. 30, 2019

(54) VACUUM CLEANER

(71) Applicant: LG ELECTRONICS INC., Seoul (KR)

(72) Inventors: Kietak Hyun, Seoul (KR); Jungmin Ko, Seoul (KR); Soohan Eo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

(21) Appl. No.: 15/828,595

(22) Filed: Dec. 1, 2017

(65) Prior Publication Data

US 2019/0014961 A1 Jan. 17, 2019

(30) Foreign Application Priority Data

Jul. 12, 2017 (KR) ..... 10-2017-0088548

(51) Int. Cl.

*A47L 9/16* (2006.01)
*A47L 9/10* (2006.01)
*A47L 9/20* (2006.01)

(52) U.S. Cl.

CPC ..... *A47L 9/1608* (2013.01); *A47L 9/108* (2013.01); *A47L 9/1633* (2013.01); *A47L 9/1641* (2013.01); *A47L 9/1675* (2013.01); *A47L 9/1691* (2013.01); *A47L 9/20* (2013.01)

(58) Field of Classification Search

CPC ..... A47L 9/1608; A47L 9/108; A47L 9/1633; A47L 9/1641; A47L 9/20

See application file for complete search history.

(56) References Cited

U.S. PATENT DOCUMENTS

2004/0177471 A1 9/2004 Jung et al.
2008/0264007 A1* 10/2008 Oh ..... A47L 9/108 55/304
2016/0088988 A1 3/2016 Eo et al.
2016/0100728 A1* 4/2016 Lavoie ..... B01D 46/2403 55/447
2018/0185779 A1* 7/2018 Nicolaou ..... B01D 46/0065
2018/0192841 A1* 7/2018 Nicolaou ..... A47L 9/20

FOREIGN PATENT DOCUMENTS

KR 10-2004-0023417 3/2004
KR 100479377 3/2005
KR 100485708 4/2005
KR 10-2006-0112420 11/2006
KR 10-2016-0038570 4/2016
KR 10-2016-0073820 6/2016

OTHER PUBLICATIONS

International Search Report dated Apr. 12, 2018 issued in Application No. PCT/KR2017/008090.

* cited by examiner

*Primary Examiner* — Dung Van Nguyen
(74) *Attorney, Agent, or Firm* — Ked & Associates, LLP

(57) ABSTRACT

Provided is a vacuum cleaner separating and collecting dust, or the like, using a multi-cyclone and mesh filter. The vacuum cleaner includes a cleaning unit sweeping dust and foreign objects clinging on the mesh filter down along an outer circumferential surface of the mesh filter and a rotary unit coupled to the mesh filter and relatively rotating the mesh filter with respect to the cleaning unit. Since the cleaning unit automatically/manually cleans a surface of the filter during an operation of the cleaner, the surface of the filter may be maintained to be clean and a load applied to a fan unit due to a foreign object or dust may be reduced.

20 Claims, 8 Drawing Sheets

VACUUM CLEANER

CROSS-REFERENCE TO RELATED APPLICATION

This application claims priority under 35 U.S.C. § 119 to Korean Application No. 10-2017-0088548, filed on Jul. 12, 2017, whose entire disclosure is hereby incorporated by reference.

BACKGROUND

1. Field

The present disclosure relates to a vacuum cleaner which separately collecting foreign objects, dust, and fine dust using multiple cyclones.

2. Background

A vacuum cleaner is an apparatus for sucking air using a suction force, filtering and collecting a foreign object, dust, fine dust, and the like, included in the air, and externally discharging clean air.

Types of vacuum cleaner may be classified as i) canister type, ii) upright type, iii) hand type, iv) cylinder floor type, and the like. The canister type vacuum cleaner is mostly commonly used in households, having a structure in which a suction unit and a cleaner body are separated. In general, the canister type vacuum cleaner does not have a rotary brush in the suction unit, and since the canister type vacuum cleaner performs cleaning only by sucking air through the suction unit, it is not appropriate for cleaning a floor.

Meanwhile, the upright type vacuum cleaner has a structure in which a suction unit is integrally formed in a cleaner body. In general, the upright type vacuum cleaner has a rotary brush so it can advantageously remove even dust in a carpet, or the like, unlike the canister type vacuum cleaner.

Recently, in order to separate particles such as dust, or the like, from an air current of a vacuum cleaner, a cyclone separating device has been used. Conventionally, two cyclones are provided to allow an air current to continuously pass therethrough. Among the two cyclones, a first cyclone is configured to separate larger dust and foreign object from an air current by a filter, and a second cyclone is configured to separate smaller dust (fine dust) from the air current which has passed through the first cyclone. Meanwhile, most of foreign objects or dust which have not passed through the first cyclone are dropped and collected to a dust storage part provided within the vacuum cleaner.

However, according to circumstances, foreign objects or dust are arrested by or gather on the filter and settle therein to reduce a region of the filter allowing air to pass therethrough. Thus, a load applied to a fan unit providing a suction force may be increased and an appearance thereof is visually not tidy.

Also, conventionally, in order to remove foreign objects or dust clinging on an outer circumferential surface of a filter, a vacuum cleaner having a cleaning unit has been attempted to be developed, but it has a problem in that, even after the filter is cleaned, a portion of foreign objects or dust is arrested by the cleaning unit so cannot be dropped to the dust storage part but gather in the cleaning unit.

Korean Patent Laid-Open Publication No. 10-2004-0023417 (published on Mar. 18, 2004) discloses a structure in which a tapered skirt having an area increased in a downward direction to prevent scattering of foreign objects and dust stored in a first storage unit below a first cyclone. Since a portion where the skirt is formed forms a small gap with an external case, a large foreign object or dust may be caught in the gap. When a foreign object is caught in the gap, introduction of another foreign object of dust to the first storage through the gap is hampered.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements, and wherein.

DETAILED DESCRIPTION

Figure 1:
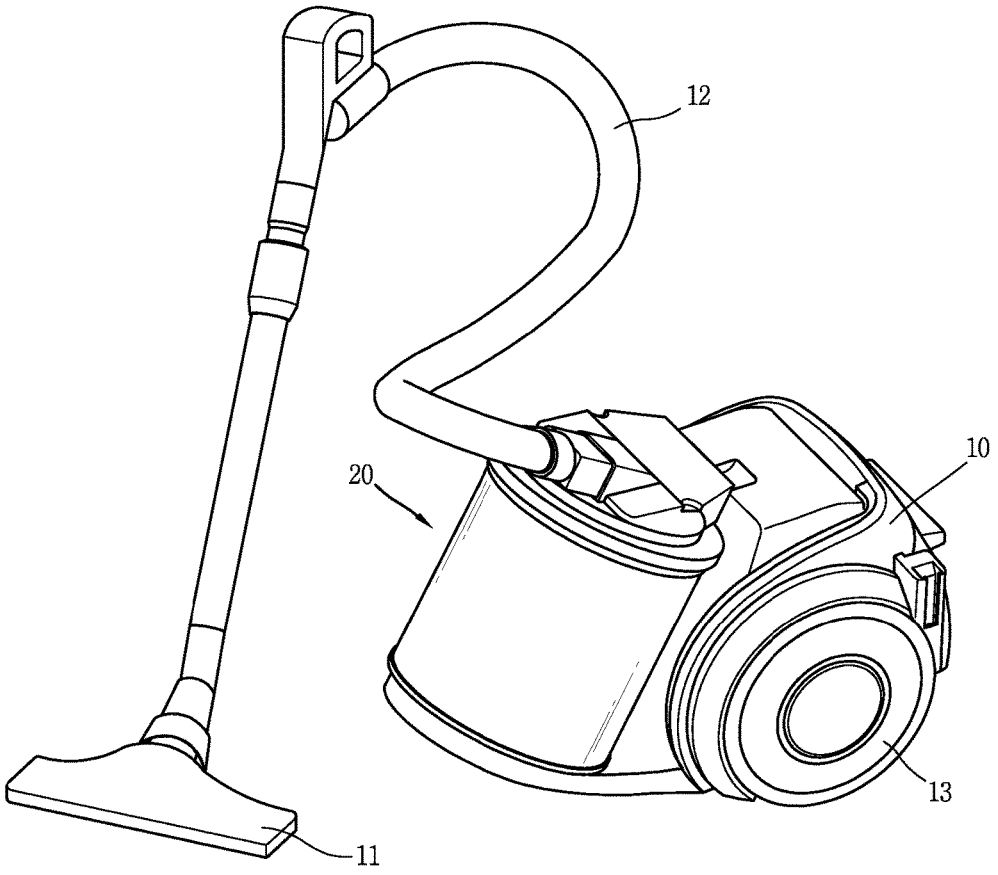
FIG. 1 is a perspective view illustrating a vacuum cleaner according to an embodiment of the present disclosure.

FIG. 1 is a perspective view illustrating a vacuum cleaner according to an embodiment of the present disclosure. The vacuum cleaner according to an embodiment of the present disclosure may include a cleaner body 10, a suction unit 11, a connection unit 12, a wheel unit 13, and a dust collecting device (or dust collector) 20.

The cleaner body 10 includes a fan unit (not shown) generating a suction force. The fan unit includes a suction motor and a suction fan rotated by the suction motor to generate a suction force. The suction unit 11 is provided to be close to or contact with a cleaning target surface such as a floor and suck ambient air of the suction unit 11. The sucked air may include a foreign object, dust, fine dust, ultra-fine dust, and the like.

The connection unit 12 is connected to the suction unit 11 and the dust collecting device 20 to transmit air including a foreign object, dust, fine dust, ultra-fine dust, and the like, sucked through the suction unit 11 to the dust collecting device 20. The connection unit 12 may be configured in the form of a hose or a pipe. Since the connection unit 12 is directly connected to the dust collecting device 20, air sucked through the suction unit 11 may be directly introduced to the dust collecting device 20, and thus, a suction force may be enhanced, compared with the related art.

The wheel unit 13 may be rotatably coupled to the cleaner body 10 and rotate to move or rotate the cleaner body 10 in every direction. For example, the wheel unit 13 may include a man wheel and an auxiliary wheel. The main wheel is provided on both sides of the cleaner body 10, and the auxiliary wheel may be configured to support the cleaner body 10 together with the main wheel and assist movement of the cleaner body 10. In the present disclosure, as the suction unit 11, the connection unit 12, and the wheel unit 13, those provided in the existing vacuum cleaner may be applied as is, and thus, detailed descriptions thereof will be omitted.

The dust collecting device 20 is detachably coupled to the cleaner body 10. The dust collecting device 20 is configured to separately collect a foreign object, dust, and fine dust from sucked air and discharge filtered air. For reference, in this disclosure, the dust collecting device 20 applied to a canister type vacuum cleaner is illustrated, but the dust collecting device 20 of the present disclosure is not necessarily limitedly applied to the canister type vacuum cleaner. The dust collecting device 20 of the present disclosure may also be applied to an upright type vacuum cleaner.

Figure 2:
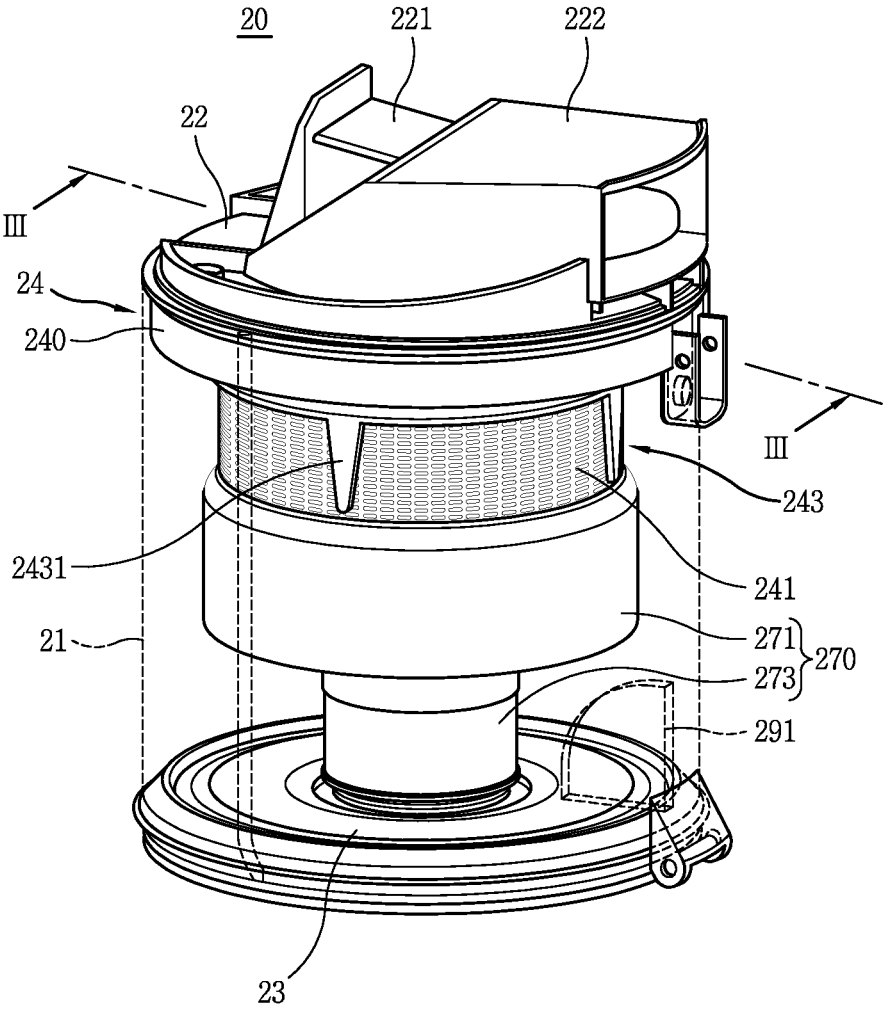
FIG. 2 is a perspective view illustrating a dust collecting device of FIG. 1.
Figure 3:
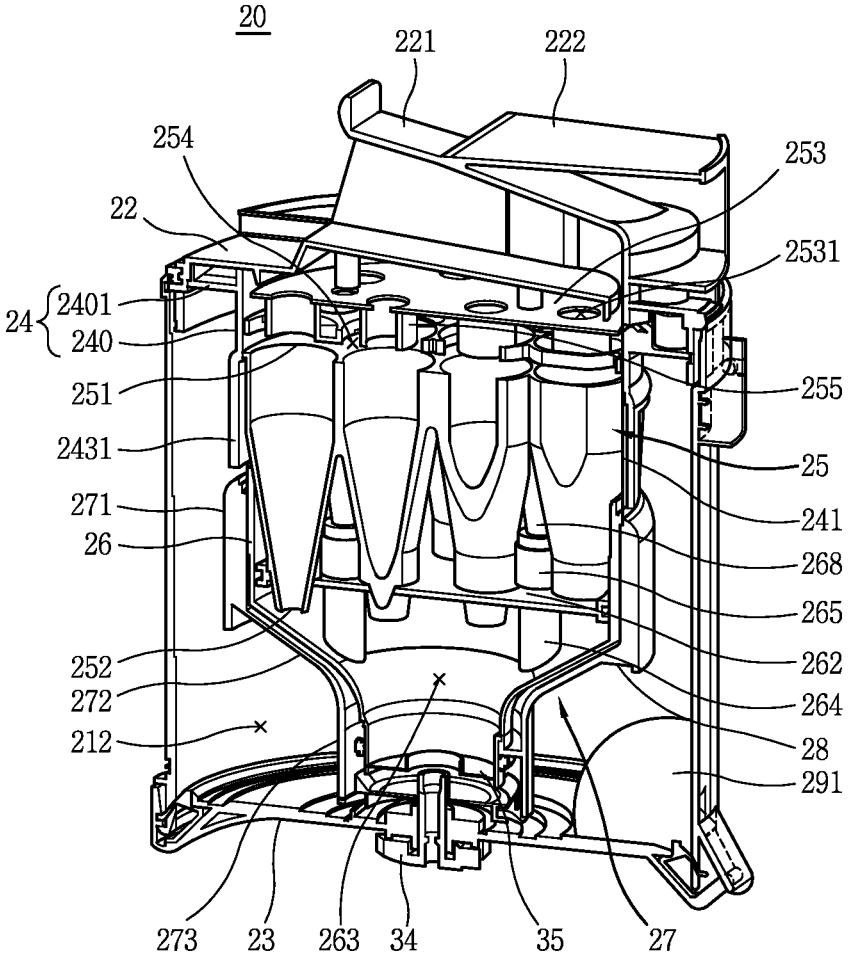
FIG. 3 is a cut-away perspective view taken along line III-III of FIG. 2.
Figure 4:
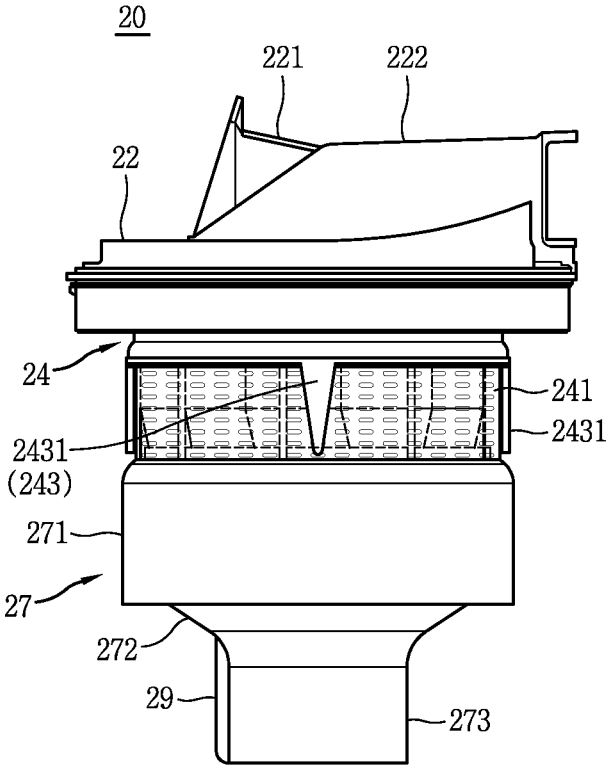
FIG. 4 is a side view illustrating components within an external case of FIG. 2.
Figure 5:
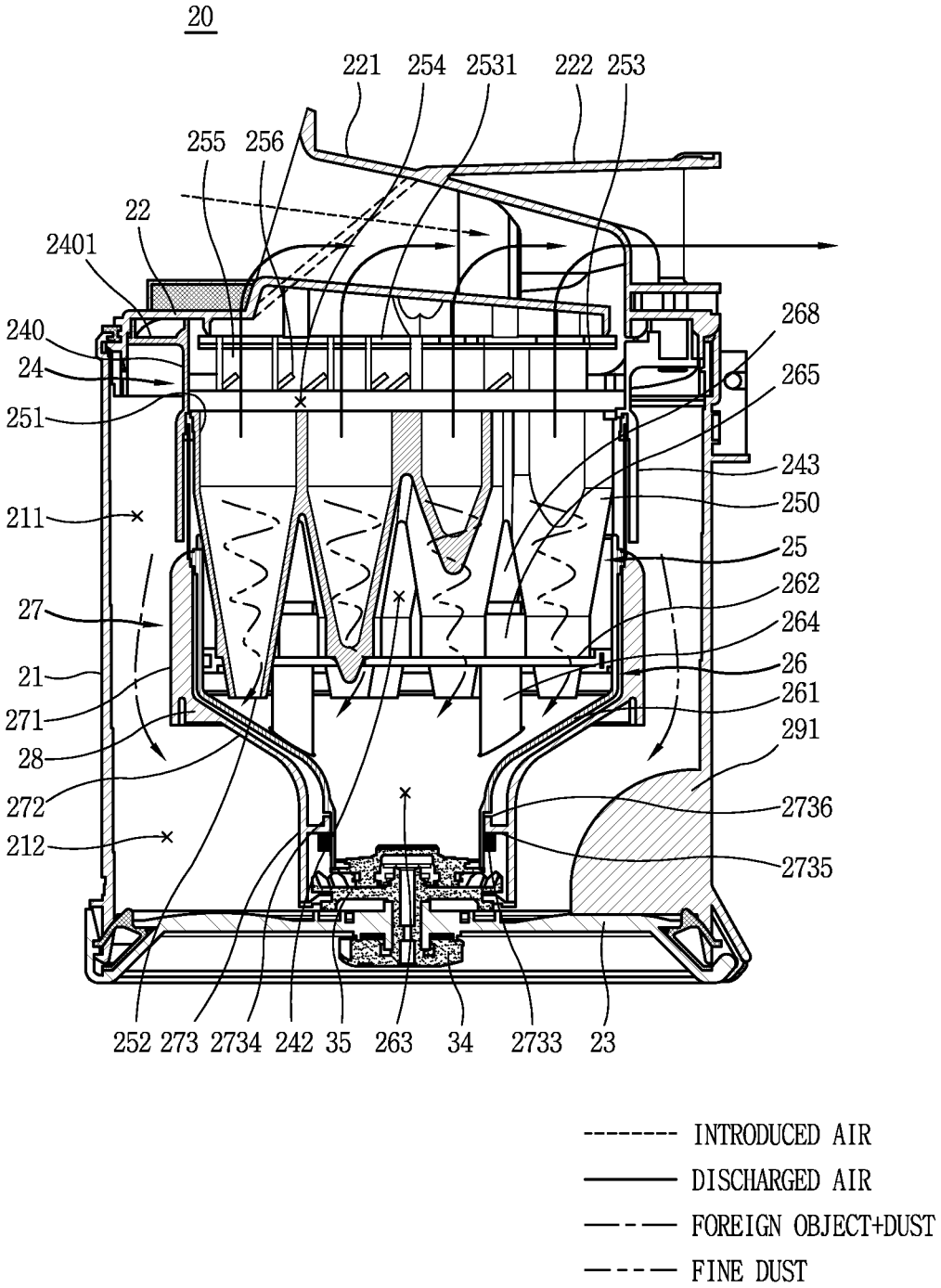
FIG. 5 is a cross-sectional view illustrating a configuration in which dust is separated from air using a multi-cyclone in FIG. 4.
Figure 6:
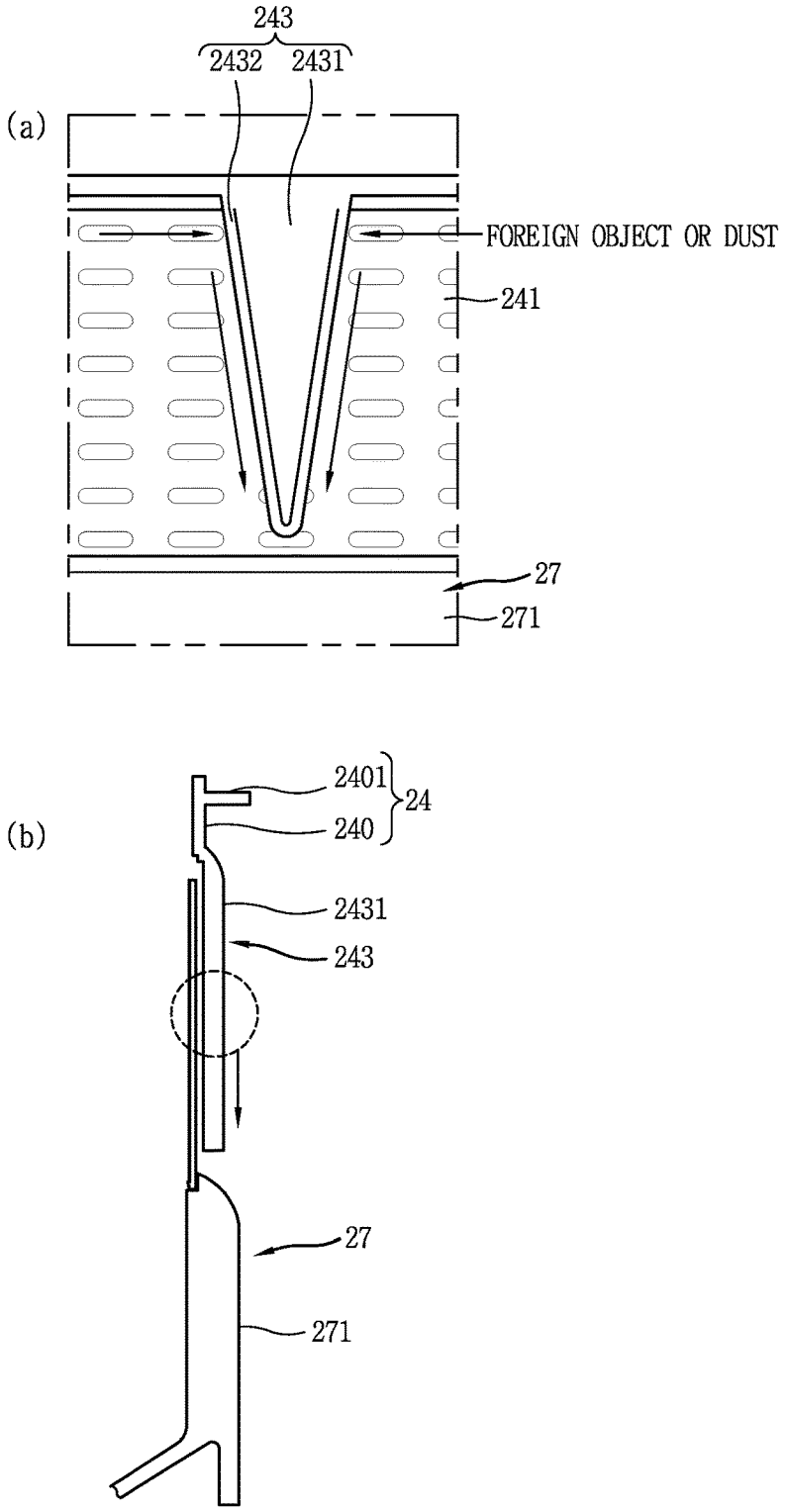
FIG. 6 is a conceptual view illustrating a configuration in which a foreign object clinging on a filter is removed by a cleaning rib.

FIG. 2 is a perspective view illustrating the dust collecting device 20 of FIG. 1, FIG. 3 is a cut-away perspective view taken along line III-III of FIG. 2, FIG. 4 is a side view illustrating components within an external case 21 of FIG. 2, FIG. 5 is a cross-sectional view illustrating a configuration in which dust is separated from air using a multi-cyclone in FIG. 4, and FIG. 6 is a conceptual view illustrating a configuration in which a foreign object clinging on a filter 241 is removed by a cleaning rib 2431.

Ambient air is sucked by the suction unit 11 by means of a suction force generated by the fan unit and introduced to the inside of the dust collecting device 20 through the connection unit 12. The dust collecting device 20 may include an external case 21, an upper cover 22, a lower cover 23, a multi-cyclone, and the like. The external case 21 may form an appearance of the dust collecting device 20 and has a cylindrical shape. An upper portion and a lower portion of the external case 21 may be separately opened. A dust storage part (or first dust storage space) 212 for storing a foreign object or dust is provided within the external case 21.

The upper cover 22 may be provided to cover an upper portion (or upper opening) of the external case 21 and form an upper appearance of the dust collecting device 20. An intake guide 221 and an exhaust guide 222 are provided in the upper cover 22. The intake guide 221 may be connected to the connection unit 12 and extends toward an inner circumference of the external case 21 so that sucked ambient air may be tangentially introduced to the inside of the external case 21 and circle along an inner circumference of the external case 21. The exhaust guide 222 is configured to externally discharge air without a foreign object, dust, and the like, by multiple cyclones. An inlet formed at a front end of the intake guide 221 and an outlet formed at a rear end of the exhaust guide 222 are opened in mutually opposite directions and communicate with an end portion of the connection unit 12 and the outside of the external case 21, respectively. The outlet may be provided on both sides of the upper cover 22 with the inlet interposed therebetween.

Air discharged through the outlet of the dust collecting device 20 may be discharged outwardly through an exhaust (not shown) of the cleaner body 10. A porous pre-filter (not shown) configured to filter ultra-fine dust from air may be installed in a flow channel from the outlet of the dust collecting device 20 to the exhaust of the cleaner body 10.

The lower cover 23 is provided to cover a lower portion (or lower opening) of the external case 21 and coupled to the lower portion of the external case 21 by a hinge, and rotate about the hinge to selectively open and close the dust storage part 212 of the external case 21. The cleaner may operate with the lower cover 23 closed, and when the lower cover 23 is open, foreign objects, dust, and the like, stored in the dust storage part 212 may be discharged downwards.

The multi-cyclone includes a plurality of cyclones, for example, at least two cyclones. A cyclone refers to a device providing a flow of circling to a fluid with particles floating therein to separate the particles (dust, etc.) from the fluid by means of a centrifugal force. The cyclone separates a foreign object, dust, and fine dust from air introduced to the inside of the dust collecting device 20 by a suction force of the fan unit. In this disclosure, relatively large dust will be referred to as "dust" or first contaminants), relatively small dust will be referred to as "fine dust", and dust smaller than fine dust will be referred to as "ultra-fine dust" (or the relatively small dust and fine dust may be collectively referred to as "second contaminents"). The multi-cyclone may include first and second cyclones 24 and 25.

The first cyclone 24 is installed within the external case 21. The first cyclone 24 may be provided in an upper portion within the external case 21. The first cyclone 24 is configured to filter out a foreign object and dust from introduced air and allows air without a foreign object and dust to be introduced to the inside of the external case 21. The first cyclone 24 may include a housing 240 and a mesh filter (or filter) 241.

The housing 240 may form an appearance of the first cyclone 24 and have a cylindrical shape like the external case 21. A support 2401 for coupling with the external case 21 may protrude in a radial direction in the housing 240. For example, the support 2401 may protrude outwardly in the radial direction along a circumferential direction from an upper side of the housing 240, and may be coupled to an upper portion of the external case 21. The housing 240 is formed to be empty therein to accommodate the second cyclone 25. An opening communicating with the inside of the housing 240 is provided on an outer circumference of the housing 240.

The mesh filter 241 may be provided to cover the opening and rotatably mounted at an upper end of a rotary unit 27 (also referred to as a rotary case) to be described hereinafter. The mesh filter 241 has a form of a mesh or is porous to allow air to pass therethrough. The mesh filter 241 is configured to separate a foreign object and dust from air introduced to the inside of the housing 240.

A reference for a size to discriminate between dust and fine dust may be determined by the mesh filter 241. Small dust passing through the mesh filter 241 may be classified as "fine dust", and large dust which cannot pass through the mesh filter 241 may be classified as "dust".

A process of separating a foreign object and dust by the first cyclone 24 will be described in detail. Air including a foreign object, dust, and fine dust is introduced to an annular space 211 between the external case 21 and the first cyclone 24 through the outlet of the intake guide 221 and circle in the annular space 211. During this process, relatively weighty foreign object and dust gradually flow downwards, while spirally circling along the annular space 211 by a centrifugal force and are collected to the dust storage part 212 as described hereinafter.

The foreign object and dust filtered out through the first cyclone 24 are collected to the dust storage part 212 positioned in a lower region within the external case 21. The dust storage part 212 may also be termed a foreign object/dust storage part in that it forms a space in which a foreign object and dust are stored. In the drawing, the inner circumferential surface of the external case 21 and the rotary unit 27 may form the dust storage part 212. A bottom surface of the dust storage part 212 may be formed by the lower cover 23.

Meanwhile, unlike a foreign object and dust, air is introduced to the inside of the housing 240 through the mesh filter 241 by a suction force. Here, fine dust, lighter than dust, may also be introduced, together with air, to the inside of the housing 240.

Referring to FIGS. 3 and 5, an internal structure of the dust collecting device 20 and air flow within the dust collecting device 20 can be checked. The second cyclone 25 is provided within the first cyclone 24 to separate air and fine dust introduced to the inside through the inlet 251. As illustrated in FIG. 3, the second cyclone 25 may be provided in plurality. A central axis of the second cyclone 25 and a central axis of the first cyclone 24 may be parallel.

The second cyclone 25 may be configured to be accommodated within the first cyclone 24. For example, the plurality of second cyclones 25 may be provided along a circumference of the first cyclone 24, and another second cyclone 25 may be provided at the center of the first cyclone 24. According to this structure, a height of the dust collecting device 20 may be lowered, compared with an existing multi-cyclone in which the first and second cyclones 25 are provided in upper and lower portions, respectively.

Among the first cyclone 24 and second cyclones 25, cyclones provided to be adjacent to each other form a first space 242. For example, an empty space between the inside of the first cyclone 24 and the second cyclones 25 may be understood as the first space 242. The first space 242 forms a flow channel allowing air and fine dust introduced to the inside of the first cyclone 24 to be introduced to an upper portion of the second cyclone 25.

Each of the second cyclones 25 extends in a vertical direction, and the plurality of second cyclones 25 may be provided to be parallel to each other. According to this disposition, the first space 242 may extend in a vertical direction within the first cyclone 24. The inlet 251 may be formed in an upper portion of the second cyclone 25, and the outlet 252 may be formed in a lower portion of the second cyclone 25.

Among the second cyclones 25, cyclones provided to be adjacent to each other may be provided to be in contact with each other. For example, a conic casing 250 forming an appearance of any one of the second cyclones 25 may be provided to be in contact with a casing 250 of another second cyclone 25 adjacent thereto to form the first space 242. The respective casings 250 of the second cyclones 25 may be integrally formed. According to this structure, the plurality of second cyclones 25 are modularized to be installed within the first cyclone 24.

The second cyclone 25 may have a circular shape when viewed from above. Among the second cyclones 25, second cyclones 25 arranged along the inner circumference of the first cyclone 24 may be provided to be in contact with an inner circumferential surface of the first cyclone 24. In detail, an inner circumferential surface of the housing 240 and an outer circumferential surface corresponding to a cylindrical portion of the casing 250 may be adjacent to be in contact with each other.

According to the layout structure, the second cyclones 25 may be effectively provided within the first cyclone 24. In particular, since the second cyclone 25 of the present disclosure does not have a guide flow channel (i.e., a flow channel allowing air and fine dust to be tangentially introduced and circle along an inner circumference of the second cyclone) extending from one side of the existing second cyclone, a larger number of second cyclones 25 may be provided within the first cyclone 24. Thus, although the second cyclones 25 are accommodated within the first cyclone 24, the number of the second cyclones 25 is not reduced, compared with the related art, a degradation of cleaning performance may be prevented.

A cover member 253 is provided above the second cyclone 25. The cover member 253 is provided to be spaced apart from the inlet 251 of the second cyclone 25 such that the cover member 253 covers the inlet 251. The cover member 253 forms a second space 254 with the inlet 251 and communicates with the first space 242. The second space 254 extends in a horizontal direction on the second cyclones 25 and communicate with the inlet 251 of the second cyclone 25. According to this structure, air introduced to the inside of the first cyclone 24 may be introduced to the inlet 251 on an upper portion of the second cyclone 25 through the first space 242 and the second space 254.

A vertex finder 255 for discharging air, from which fine dust was separated, is provided at the center of an upper portion of the second cyclone 25. The inlet 251 may be defined as an annular space between an inner circumference of the second cyclone 25 and an outer circumference of the vertex finger 255.

A guide vane 256 may be formed at the inlet 251 and spirally extend along an inner circumference. The guide vane 256 may be installed on an outer circumference of the vertex finder 255 or may be integrally formed with the vertex finder 255. According to this, air introduced to the inside of the second cyclone 25 through the inlet 251 may rotate.

Flow of air and fine dust introduced to the inlet 251 of the second cyclone 25 will be described in detail. Fine dust, while spirally circling along the inner circumference of the second cyclone 25, gradually flows downwards and finally are discharged through the outlet 252 so as to be collected in a fine dust storage part (or second dust storage space) 263 of an internal case 26 (to be described hereinafter). Also, air lighter than fine dust is discharged to the upper vertex finder 255 by a suction force of the fan unit. According to the structure of the second cyclone 25, air introduced to the inlet 251 uniformly rotates in the almost entire region of the inlet 251.

A communication hole 2531 corresponding to the vertex finder 255 is formed in the cover member 253. The cover member 253 may be provided to cover an internal space of the first cyclone 24, excluding the vertex finder 255. An upper cover 22 is provided above the cover member 253.

Meanwhile, the internal case 26 accommodating the outlet 252 of the second cyclone 25 is provided below the first cyclone 24. A partition 262 extending in a horizontal direction is installed within the internal case 26. An outer circumferential portion of the partition 262 may be coupled to an inner circumferential surface of the internal case 26. The partition 262 and the internal case 26 may be coupled by a coupling structure such as a protrusion and a protrusion insertion recess, and the like.

The partition 262 may form a bottom surface of the first cyclone 24. The partition 262 may partition an internal space of the internal case 26 into an accommodation space for accommodating the second cyclones 25 and the fine dust storage part 263 for collecting fine dust discharged through the outlet 252 of the second cyclone 25. The accommodation space may be provided above the partition 262 and the fine dust storage part 263 may be provided below the partition 262. The partition 262 may be spaced apart from a tapered part (or tapered surface) 261 of the internal case 26 in an upward direction.

A through hole allowing the second cyclone 25 to be inserted therein is formed in the partition 262. A lower portion of the second cyclone 25 penetrates through the through hole of the partition 262 and protrudes to the inside of the fine dust storage part 263.

The internal case 26 extends toward the lower cover 23. The internal case 26 may have a bowl shape having the tapered part 261 in which a sectional area of an upper end thereof is smaller than a sectional area of a lower end thereof and a sectional area is gradually reduced. The upper end portion and the lower end portion of the internal case 26 are open in a vertical direction. The upper end portion of the internal case 26 may communicate with the first space 242 and the lower end portion of the internal case 26 may communicate with the outside of the external case 21 when the lower cover 23 is open. Here, the lower cover 23 may simultaneously open the dust storage part 212 of the external case 21 and the fine dust storage part 263 of the internal case 26.

The internal case 26 may be coupled to the second cyclone 25 by a fastening unit. The second cyclone 25 may be integrally formed with the housing 240 of the first cyclone 24 through injection molding, or the like. The fastening unit may include a plurality of columns 264, a boss part 265, and a screw (or connector) 266.

First fastening holes 267 may be formed on both sides of a bottom surface of the tapered part 261, and second fastening holes may be formed on both sides of the partition 262 to correspond to the first fastening holes 267 in a vertical direction. Each of the plurality of columns have a circular hollow pipe shape, and a lower end and an upper end of each column 265 extends in a vertical direction to communicate with the first fastening hole 267 of the tapered part 261 and the second fastening hole of the partition 262.

The plurality of boss parts 265 extend from the second fastening hole of the partition 262 toward the second cyclone 25, and a plurality of protrusions 268 may protrude downwards toward the partition 262 in the second cyclone 25. The plurality of screws 266 are fastened to the plurality of protrusions 268 through the plurality of columns 264 and boss parts 265, respectively, in a lower portion of the tapered part 261, whereby the internal case 26 may be fastened to the first and second modularized cyclones 25.

In the present disclosure, a cleaning unit (or cleaning extensions) 243 removing a foreign object, dust, and the like, clinging on the mesh filter 241 is provided. The cleaning unit 243 may be provided on an outer circumferential surface of the first cyclone 24. In detail, the cleaning unit 243 includes a plurality of cleaning ribs 2431. The cleaning ribs 2431 may extend to protrude in a downward direction from the housing 240 to cover a portion of an outer circumferential surface of the mesh filter 241. The plurality of cleaning ribs may be provided to be spaced apart from each other at a predetermined interval along an outer circumference of the housing 240. In FIG. 2, four cleaning ribs 2431 are provided to be spaced apart from each other at an interval of 90°, but the present disclosure is not limited thereto.

An upper end of each of the plurality of cleaning ribs 2431 is integrally connected to the housing 240, and both sides of each of the cleaning ribs 2431 slope to be reduced downwards in width of portions connected to the housing 240. Sloped surfaces respectively formed on both sides of each of the cleaning ribs 2431 may be symmetrical with respect to a vertical central line in a vertical direction. Each of the cleaning ribs 2431 may have a reverse equilateral triangular shape. Blade part 2432 may be provided on the sloped edge portions of both sides of the cleaning rib 2431 to cut and sweep down a foreign object, dust, and the like, clinging on the filter 241.

The cleaning unit 243 includes a plurality of support ribs 2433. Each support rib extends downwards to protrude from the housing 240 to cover a portion of an inner circumferential surface of the mesh filter 241 and support the mesh filter 241. The plurality of support ribs 2433 may have a strip shape which is long and narrow. An upper end portion of each support rib 2433 may be integrally formed to be connected to the housing 240. The support rib 2433 may have a uniform width from an upper portion to a lower portion thereof. The upper end of the support rib 2433 may be supported by the housing 240, and the lower end of the support rib 2433 may be coupled to an upper end of the internal case 26 and supported by the internal case 26. The support rib 2433 and the internal case 26 may be fastened by a fastening unit such as a hook (arrest recess), an adhesive, and the like.

Here, the support rib 2433 overlaps the mesh filter 241 in a radial direction. The support rib 2433 is provided to be in contact with the mesh filter 241 and limits movement of the mesh filter 241 in a radial direction with respect to the first cyclone 24 and allows the mesh filter 241 from rotating in a circumferential direction.

The cleaning unit 243 may be connected and fixed to the housing 240 of the first cyclone 24. The mesh filter 241 may be connected to the rotary unit 27 (to be described hereinafter) and rotate together with the rotary unit 27. The mesh filter 241 may relatively rotate with respect to the cleaning unit 243. The mesh filter 241 may rotate in both directions (clockwise direction or counterclockwise direction) based on a virtual longitudinal central line of the internal case 26.

A principle and operation of removing foreign objects, dust, and the like, clinging on the filter 241 by the cleaning unit 243 will be described with reference to FIG. 6. The rotary unit 27 rotates the mesh filter 241 in a circumferential direction to apply a rotational power to foreign objects, dust, and the like, clinging on the mesh filter 241. As foreign objects, dust, and the like, rotating in a circumferential direction together with the filter 241, is caught by the cleaning rib 2431, the foreign object, dust, and the like, are separated from the mesh filter 241 by the cleaning rib 2431. Here, a portion of the foreign objects or dust caught by the cleaning rib 2431 may move along the sloped surfaces of the cleaning rib 2431 so as to be dropped down.

According to the reverse triangular structure of the cleaning rib 2431, rotational force applied to the foreign objects, dust, and the like, are switched from a circumferential direction (horizontal direction) to a diagonal direction by the sloped surfaces of the cleaning rib 2431 to provide directionality to the foreign objects, dust, and the like, such that foreign objects, dust, and the like, may be smoothly released downwards. In order to explain such an effect, the cleaning rib bent in an orthogonal direction as in the related art and the cleaning rib 2431 of the present disclosure having sloped surfaces in a diagonal direction according to the present disclosure may be compared as follows.

First, in the case of the structure in which the cleaning rib is bent in an orthogonal direction without a sloped surface in a diagonal direction, a foreign object, dust, and the like, may be caught in a corner portion bent from a horizontal direction to a vertical direction. However, the cleaning rib 2431 according to the present disclosure has sloped surfaces on both sides thereof in a diagonal direction, preventing a foreign object, dust, and the like, from being caught Second, when a foreign object, dust, and the like to which a rotational force is applied in a circumferential direction (horizontal direction) is caught in the cleaning rib bent at a right angle, the cleaning rib bent at the right angle may be more damaged than the cleaning rib 2431 having a sloped surface in a diagonal direction. In contrast, since the cleaning rib 2431 according to the present disclosure distributes a force applied in a circumferential direction into a horizontal direction and a vertical direction by virtue of the sloped surface, an impact applied by a rotating foreign object, dust, and the like, may be reduced.

Third, when a foreign object, dust, and the like, rotating in a circumferential direction is caught in the cleaning rib bent at a right angle, the foreign object, dust, and the like, may be dropped down to the dust storage part only by gravity. In contrast, since the cleaning rib 2431 of the present disclosure distributes a force of a circumferential direction into a force of a horizontal direction (circumferential direction) and a vertical direction (gravity direction) by the sloped surface of a diagonal direction, a force of the vertical direction, together with gravity, may be applied to the foreign object, dust, and the like, to cause the foreign object, dust, and the like, to be dropped down.

Fourth, since the cleaning rib bent at a right angle has a vertically uniform width, a passage for dust, or the like, to move down may be narrow. In contrast, in the cleaning rib 2431 according to the present disclosure, since a width of a portion connected to the housing is increased downwards, and thus, a path for dust, or the like, to move down may be secured to be wide.

The rotary unit 27 may be configured to be rotatable in both directions (clockwise direction and counterclockwise direction) within the dust storage part 212. The rotary unit 27 may be configured to correspond to an appearance of the internal case 26 and cover the internal case 26. According to the aforementioned structure, when the rotary unit 27 rotates, the internal case 26 serves as a rotation shaft of the rotary unit 27. Thus, since the internal case 26 serves as a rotation shaft, the rotary unit 27 may be stably rotated even without a separate member.

The rotary unit 27 may include a skirt part (or skirt surface) 271, a sloped part (or sloped surface) 272, and a base part (or base cylinder) 273. The skirt part 271 forms an upper appearance of the rotary unit 27. The skirt part 271 covers an upper portion of the internal case 26 and has a uniform diameter in a vertical direction. An outer circumferential surface of the skirt part 271 is spaced apart from an inner circumferential surface of the external case 21 by a preset interval to form an annular space between the external case 21 and the skirt part 271. The outer circumferential surface of the skirt part 271 and the outer circumferential surface of the cleaning rib 2431 may be provided to be parallel.

According to the vertical skirt part 271, a large foreign object or dust which cannot pass through the mesh filter 241 may easily pass through the annular space 211 between the skirt part 271 and the external case 21. Also, by the cleaning unit 243, a foreign object, dust, and the like, released from the mesh filter 241 may be dropped down in a vertical direction without an interference. The sloped part 272 is configured to correspond to the tapered part 261 of the internal case 26 and surround the tapered part 261.

The base part 273 may vertically extend from a lower end of the sloped part 272. The base part 273 may have a diameter smaller than that of the skirt part 271. A plurality of fastening recesses 2731 may be formed on an inner circumferential surface of the base part 273. The plurality of fastening recesses 2731 may be provided to be spaced apart from each other in a circumferential direction. A plurality of fastening protrusions 2732 may protrude from between the plurality of fastening recesses 2731. The plurality of fastening recesses 2731 and the fastening protrusions 2732 may be alternately provided in a circumferential direction. The plurality of fastening recesses 2731 are provided to receive power from a driving part transmission unit (to be described hereinafter).

An arrest part 2733 may protrude from a lower end portion of an outer circumferential surface of the internal case 26. A rotation support recess 2734 may be formed in an upper portion of the arrest part 2733 in a circumferential direction. The arrest part 2733 may be detachably screw-coupled to the internal case 26.

A rotation support part 2735 may protrude from an inner circumferential surface of the base part 273 in a circumferential direction, and a rotation support protrusion 2736 may protrude from an end portion of the rotation support part 22735 in an upward direction. As the rotation support protrusion 2736 is inserted and coupled to the rotation support recess 2734, the rotary unit 27 rotatably supported in a state of being caught by the arrest part 2733 of the internal case 26 in a gravity direction. According to the structure of the arrest part 2733, since the rotary unit 27 is caught by the internal case 26, although the lower cover 23 is rotated to open the dust storage part 212, the rotary unit 27 may be fixed in place.

The skirt part 271 may protrude to be lower than the sloped part 272 in a downward direction. A rolling part 28 may be provided at a lower end portion of the protruding skirt part 271. The rolling part 28 may include a plurality of rolling ribs extending in a radial direction between a lower end of the skirt part 271 and an upper end portion of the sloped part 272. The plurality of rolling ribs may be provided to be spaced apart from each other at a predetermined interval in a circumferential direction. The plurality of rolling ribs may be provided toward the lower cover 23.

The rolling part 28 may be connected to the rotary unit 27, and when the rolling part 28 rotates together with the rotary unit 27, foreign objects and dust collected to the dust storage part 212 collide with the plurality of rolling ribs and rotate to clump together in a spherical shape and are rolled. In this manner, when foreign objects and dust clump in a spherical shape by the rolling part 28, a backflow due to adaptation of the foreign objects and dust (a phenomenon in which foreign objects and dust of the dust storage part 212 are heaped to come up to the annular space 211 between the first cyclone 24 and the external case 21) may be prevented. When the rolling part 28 and a pressing part 29 are additionally added, foreign objects and dust may be clumped and compressed together to enhance foreign object and dust collecting performance, and thus, a backflow possibility may be significantly lowered. Also, when the dust storage part 212 is removed, scattering of dust may be minimized.

The pressing part 29 may extend from one side of the rotary unit 27, i.e., from outer circumferential surfaces of the base part 273 and the sloped part 272 in a radial direction. An outer portion of the pressing part 29 protrudes further than the sloped part 272 to cover a portion of the skirt part 271, and a length of the outer portion in a radial direction may extend further than an outer diameter of the skirt part 271. The pressing part 29 may rotate together with the rotary unit 27 to press foreign objects, dust, and the like, of the dust storage part 212.

An inner wall 291 may be provided within the dust storage part 212 to collect dust moved to one side according to rotation of the pressing part 29. In this embodiment, the inner wall 291 extends from a lower inner circumference of the external case 21 in a radial direction. Dust, or the like, introduced to the dust storage part 212 may be collected to both sides of the inner wall 291 according to rotation of the pressing part 29.

Figure 7:
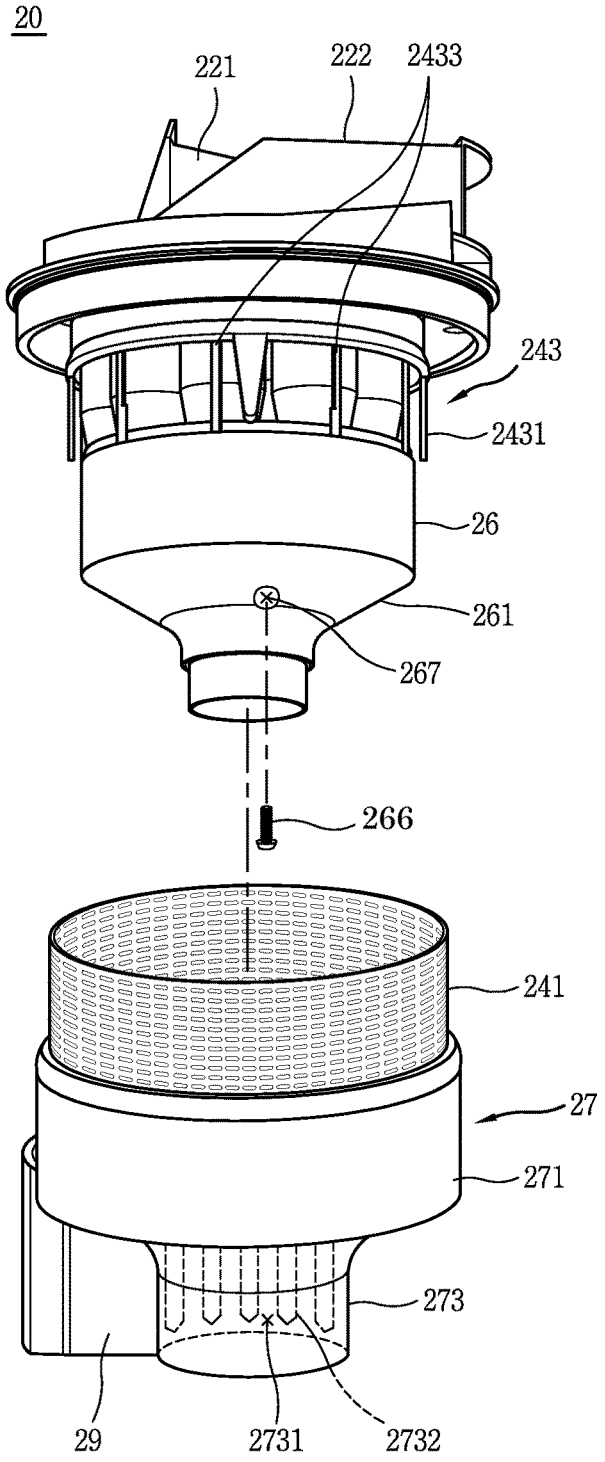
FIG. 7 is an exploded perspective view of a multi-cyclone assembly and a rotary unit of FIG. 4.
Figure 8:
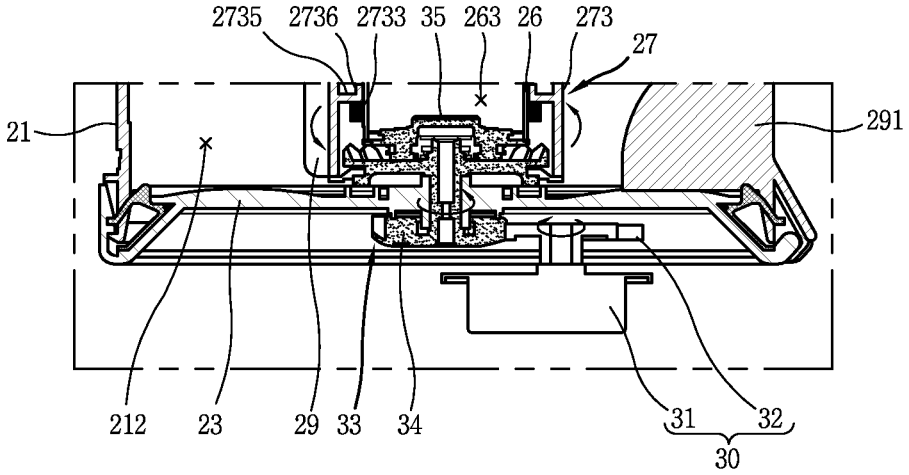
FIG. 8 is a conceptual view illustrating a configuration in which driving power generated by a driving unit is transmitted to a rotary unit through a driving power transmission unit according to an embodiment of the present disclosure.

FIG. 7 is an exploded perspective view of a multi-cyclone assembly and the rotary unit 27 of FIG. 4, and FIG. 8 is a conceptual view illustrating a configuration in which driving power generated by a driving unit 30 is transmitted to the rotary unit 27 through a driving power transmission unit (also referred to as a driving power transmission or transmission) 33 according to an embodiment of the present disclosure.

The driving unit 30 is provided in the cleaner body 10 and includes a driving motor 31 and a driving gear 32 rotatably connected to the driving motor 31. At least a portion of the driving gear 32 is exposed from the cleaner body 10 and engaged with a driven gear 34 of the driving power transmission unit 33 (to be described hereinafter) when the dust collecting device 20 is installed in the cleaner body 10.

The driving power transmission unit 33 is provided in the lower cover 23 and transmits driving power from the driving unit 30 to the rotary unit 27. The driving part transmission unit 33 includes the driven gear 34 and a fastening member 35.

The driven gear 34 is exposed to a lower side of the lower cover 23 and relatively rotate with respect to the lower cover 23. The driven gear 34 may be configured to be engaged with the driving gear to receive driving power from the driving motor 31 when the dust collecting device 20 is coupled to the cleaner body 10.

The fastening member (or fastener) 35 is connected to the driven gear 34 by a rotational shaft and rotate together with the driven gear 34. The fastening member 35 is exposed to an upper side of the lower cover 23, and when the lower cover is coupled to the external case 21, the lower cover 23 is fastened to the fastening recesses 2731 provided on the inner circumference of the base part 273. In this embodiment, a plurality of fastening recesses 2731 are provided and spaced apart from each other at a predetermined interval on an inner circumference of the base part 273, and the fastening member 35 is configured as a gear having a plurality of fastening protrusions inserted into the fastening recesses 2731. When this shape is considered, the fastening member 35 may be termed a fastening gear.

According to this structure, when the lower cover 23 is coupled to the external case 21, the driving power transmission unit 33 is connected to the rotary unit 27 of the dust collecting device 20, and when the dust collecting device 20 is coupled to the cleaner body 10, the driving power transmission unit 33 is connected to the driving unit 30 of the cleaner body 10, whereby driving power generated by the driving unit 30 is transmitted to the rotary unit 27 through the driving power transmission unit 33.

Here, the driving motor 31 may be controlled in rotation such that the rotary unit 27 repeatedly rotated in both directions. For example, when a repulsive force is applied to the driving motor 31 in a direction opposite to a rotation direction, the driving motor 31 may rotate in the opposite direction. That is, when the driving motor 31 rotates in one direction, the pressing part 29 compresses dust collected to one side to a predetermined level, and when the driving motor 31 rotates in the other direction, the pressing part 29 compresses dust collected on the other side.

When there is little dust, the pressing part 29 may collide with the inner wall 291 to receive a repulsive force or receive a repulsive force by a stopper structure (not shown) provided on a rotation path of the pressing part 29 so as to be rotated in the opposite direction. Alternatively, a controller within the cleaner body 10 may apply a control signal by the driving motor 31 to change a rotation direction of the pressing part 29 at every predetermined time to cause the pressing part to repeatedly rotate in both directions.

By the pressing part 29, dust collected in the dust storage part 212 may gather to a predetermined region or compressed. Thus, during a process of discarding dust, dust may be restrained from scattering or a possibility in which dust is discharged to an unintended place may be significantly lowered.

As described above, according to the present disclosure, when the cleaner operates, the mesh filter 241 rotates upon receiving driving power generated by the driving motor 31 through the driving power transmission unit 33 and the rotary unit 27, and the cleaning unit 243 may sweep down foreign objects, dust, and the like, clinging on the mesh filter 241 to the dust storage part 212 to clean the mesh filter 241.

The user may automatically clean the mesh filter 241 while the cleaner is in use, and even when the cleaner is not in use, the user may manually clean the mesh filter 241. For example, after the dust collecting device 20 is removed from the cleaner body 10, the filter 241 may be cleaned even when the driven gear 34 exposed to a lower side of the lower cover 23 is manually driven.

Therefore, an aspect of the detailed description is to provide a vacuum cleaner capable of minimizing a phenomenon in which a filter is blocked when the cleaner operates. Another aspect of the detailed description is to provide a vacuum cleaner in which a foreign object or dust can be easily dropped to a dust storage part, without gathering in a cleaning unit. Another aspect of the detailed description is to provide a vacuum cleaner in which a phenomenon that a large foreign object or dust is caught in a skirt is minimized by changing an existing tapered skirt to a vertical skirt.

To achieve these and other advantages and in accordance with the purpose of this specification, as embodied and broadly described herein, a vacuum cleaner includes: a cleaner body; and a dust collecting device, wherein the dust collecting device includes: an external case having a dust storage part therein; an upper cover installed to cover an upper portion of the external case; a lower cover rotatably coupled to a lower portion of the external case; a first cyclone installed within the external case, having a mesh filter to filter out dust and a foreign object from air sucked from the outside, and allowing air without dust and a foreign object to be introduced to the inside thereof; a second cyclone accommodated within the first cyclone and separating fine dust from air introduced to the inside of the first cyclone; a cleaning unit sweeping dust and a foreign object clinging on the mesh filter down along an outer circumferential surface of the mesh filter; and a rotary unit coupled to the mesh filter and relatively rotating the mesh filter with respect to the cleaning unit.

The first cyclone may include a housing coupled to a lower portion of the upper cover, and the cleaning unit may include: a plurality of cleaning ribs extending in a downward direction so as to be in contact with an external circumferential surface of the mesh filter in the housing; and a plurality of support ribs extending in a downward direction so as to be in contact with an internal circumferential surface of the mesh filter to support the mesh filter in the housing.

Each of the plurality of cleaning ribs may be sloped on both sides thereof such that a width of a portion thereof connected to the housing is narrowed downwards.

The sloped surfaces on both sides of each of the cleaning ribs may be symmetrical. The plurality of cleaning ribs and the plurality of support ribs may be provided to be spaced apart from each other and stagger on the outer circumference of the housing.

The vacuum cleaner may further include: an internal case provided to cover a bottom surface of the first cyclone within the external case, having a tapered part sloped such that a sectional area thereof is narrowed from a lower end portion to an upper end portion, and extending toward the lower cover, wherein the rotary unit is formed to correspond to the internal case and coupled to the internal case so as to relatively rotate with respect to the internal case.

The rotary unit may include: a skirt part vertically extending such that a space between the rotary unit and the external case is uniformly maintained at a preset size; a sloped part formed to correspond to the tapered part at a lower end portion of the skirt part; and a base part extending from the sloped part in a downward direction and having a plurality of fastening recesses provided to be spaced apart from each other on an inner circumferential surface in a circumferential direction.

The vacuum cleaner may further include: a driving unit provided in the cleaner body and driving the rotary unit, wherein the driving unit includes a driving motor and a driving gear connected to the driving motor. The vacuum cleaner may further include: a driving power transmission unit transmitting driving power from the driving unit to the rotary unit, wherein the driving power transmission unit may include: a driven gear installed in the lower cover and exposed to a lower side of the lower cover and coupled to be engaged with the driving gear when the dust collecting device is installed in the cleaner body; and a fastening member coupled to the driven gear and exposed to an upper side of the lower cover, and coupled to be engaged with the fastening recess when the lower cover is coupled to the external case.

The vacuum cleaner may further include: a partition provided in a radial direction within the internal case to form a bottom surface of the first cyclone, and partitioning a first space within the first cyclone and a fine dust storage part for collecting fine dust discharged through an outlet of the second cyclone, wherein an outer circumferential portion of the partition is coupled to an inner circumferential surface of the internal case.

The partition may be provided to be spaced apart from the tapered part in an upward direction and include: a plurality of columns protruding and extending from the tapered part in an upward direction so as to be connected to the partition; a boss part communicating with the columns and protruding from an upper surface of the partition in an upward direction; and a screw fastened to the second cyclone through the columns and the boss part.

The present disclosure configured as described above have the following advantages. First, since the cleaning unit automatically/manually cleans the surface of the filter during an operation of the cleaner, the surface of the filter may be maintained to be clean and a load applied to the fan unit due to a foreign object or dust may be reduced. Second, since the cleaning unit provides directionality with a structure in which a foreign object or dust may easily go down when the filter is cleaned, a phenomenon that a foreign object is caught in the cleaning unit even after the filter is cleaned may be resolved.

Third, since the filter is configured to relatively rotate with respect to the cleaning unit in a state in which the cleaning unit is fixed, a foreign object or dust clinging on the filter may be more effectively removed. Fourth, since the shape of the skirt is changed from the tapered shape of the related art to the vertical shape, a phenomenon that a foreign object is caught in a gap between a portion where the skirt is formed and the external case may be minimized.

Fifth, since the filter is automatically cleaned by the cleaning unit during an operation of the cleaner, a user does not need to separately clean the filter after stopping the cleaner, simplifying management of filter cleaning by the user. Sixth, since dust stored in the dust storage part is compressed by a compressing unit and clumped by a rolling part, a volume of foreign objects and dust is minimized to reduce the number of times of emptying a dust box and a phenomenon that a foreign object or dust flows back up to the dust storage part and that dust flies when a dust box is emptied.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner body; and a dust collector received in the cleaner body, wherein the dust collector includes:

an external case having a first dust storage space therein;

an upper cover installed to cover an upper opening of the external case;

a lower cover coupled to a lower opening of the external case;

a first cyclone installed within the external case, having a mesh filter to filter first contaminants from air sucked from outside the dust collector, and configured to introduce the filtered air inside the first cyclone;

a second cyclone provided in the first cyclone and configured to separate second contaminants from the filtered air introduced inside of the first cyclone;

one or more cleaning extensions configured to remove a portion of the first contaminants clinging on an outer circumferential surface of the mesh filter; and a rotary case coupled to the mesh filter and relatively rotating the mesh filter with respect to the cleaning extensions.

2. The vacuum cleaner of claim 1, wherein the first cyclone includes a housing coupled to a lower portion of the upper cover, and the cleaning extensions include:

a plurality of cleaning ribs extending in a downward direction from the housing so as to be in contact with an external circumferential surface of the mesh filter; and a plurality of support ribs extending in the downward direction from the housing so as to be in contact with an internal circumferential surface of the mesh filter to support the mesh filter in the housing.

3. The vacuum cleaner of claim 2, wherein each of the plurality of cleaning ribs is sloped on two laterals sides thereof such that a width of a portion thereof connected to the housing is narrowed downwards.

4. The vacuum cleaner of claim 3, wherein the sloped surfaces on the two lateral sides of each of the cleaning ribs are symmetrical.

5. The vacuum cleaner of claim 2, wherein the plurality of cleaning ribs and the plurality of support ribs are provided to be spaced apart from each other and stagger on the outer circumference of the housing.

6. The vacuum cleaner of claim 1, further comprising:

an internal case provided to cover a bottom surface of the first cyclone within the external case, having a tapered surface sloped such that a sectional area thereof is narrowed from a lower end portion to an upper end portion, and extending toward the lower cover, wherein the rotary case is formed to correspond to the internal case and coupled to the internal case so as to relatively rotate with respect to the internal case.

7. The vacuum cleaner of claim 6, wherein the rotary case includes:

a skirt surface vertically extending such that a space between the rotary case and the external case is uniformly maintained at a preset size;

a sloped surface formed to correspond to the tapered surface at a lower end of the skirt surface; and a base cylinder extending from the sloped surface in a downward direction and having a plurality of fastening recesses provided to be spaced apart from each other on an inner circumferential surface thereof in a circumferential direction.

8. The vacuum cleaner of claim 6, further comprising:

a partition provided in a radial direction within the internal case to form a bottom surface of the first cyclone, and partitioning a first space within the first cyclone and a second dust storage space for collecting the second contaminants discharged through an outlet of the second cyclone, wherein an outer circumferential portion of the partition is coupled to an inner circumferential surface of the internal case.

9. The vacuum cleaner of claim 8, wherein the partition is provided to be spaced apart from the tapered surface in an upward direction and includes:

a plurality of columns protruding and extending from the tapered surface in an upward direction so as to be connected to the partition;

a boss communicating with the columns and protruding from an upper surface of the partition in an upward direction; and a connecter fastened to the second cyclone through the boss and at least one of the columns.

10. The vacuum cleaner of claim 1, further comprising:

a driving motor provided in the cleaner body and configured to provide a driving force; and a driving gear connected to the driving motor and configured to transfer the driving force to rotate the rotary case.

11. The vacuum cleaner of claim 10, wherein:

the rotary case includes a fastening recess provided on an inner circumferential surface thereof, and the vacuum cleaner further comprises:

a driving power transmission configured to transmit the driving force from the driving gear to the rotary case, the driving power transmission including:

a driven gear installed in the lower cover and exposed to a lower side of the lower cover and coupled to be engaged with the driving gear when the dust collector is installed in the cleaner body; and a fastener coupled to the driven gear and exposed to an upper side of the lower cover, and extending to engage the fastening recess when the lower cover is coupled to the external case.

12. A dust collector comprising:

an external case having a first dust storage space therein;

an upper cover installed to cover an upper opening of the external case;

a lower cover coupled to a lower opening of the external case;

a first cyclone installed within the external case, having a mesh filter to filter first contaminants from air sucked from outside the dust collector, and configured to introduce the filtered air inside the first cyclone;

one or more cleaning extensions configured to remove a portion of the first contaminants clinging on an outer circumferential surface of the mesh filter;

a rotary case coupled to the mesh filter and relatively rotating the mesh filter with respect to the cleaning extensions; and a transmission configured to transmit a driving force to the rotary case to cause the rotary case to rotate the mesh filter.

13. The dust collector of claim 12, wherein the first cyclone includes a housing coupled to a lower portion of the upper cover, and the cleaning extensions include:

a plurality of cleaning ribs extending in a downward direction from the housing so as to be in contact with an external circumferential surface of the mesh filter; and a plurality of support ribs extending in the downward direction from the housing so as to be in contact with an internal circumferential surface of the mesh filter to support the mesh filter in the housing.

14. The dust collector of claim 13, wherein each of the plurality of cleaning ribs is sloped on two laterals sides thereof such that a width of a portion thereof connected to the housing is narrowed downwards.

15. The dust collector of claim 13, wherein the plurality of cleaning ribs and the plurality of support ribs are provided to be spaced apart from each other and stagger on the outer circumference of the housing.

16. The dust collector of claim 13, further comprising:

an internal case provided to cover a bottom surface of the first cyclone within the external case, having a tapered surface sloped such that a sectional area thereof is narrowed from a lower end portion to an upper end portion, and extending toward the lower cover, wherein the rotary case is formed to correspond to the internal case and coupled to the internal case so as to relatively rotate with respect to the internal case.

17. The dust collector of claim 16, wherein the rotary case includes:

a skirt surface vertically extending such that a space between the rotary case and the external case is uniformly maintained at a preset size;

a sloped surface formed to correspond to the tapered surface at a lower end of the skirt surface; and a base cylinder extending from the sloped surface in a downward direction and having a plurality of fastening recesses provided to be spaced apart from each other on an inner circumferential surface thereof in a circumferential direction.

18. The dust collector of claim 16, further comprising:

a second cyclone provided in the first cyclone and configured to separate second contaminants from the filtered air introduced inside of the first cyclone.

19. The dust collector of claim 18, further comprising:

a partition provided in a radial direction within the internal case to form a bottom surface of the first cyclone, and partitioning a first space within the first cyclone and a second storage space for collecting the second contaminants discharged through an outlet of the second cyclone, wherein an outer circumferential portion of the partition is coupled to an inner circumferential surface of the internal case.

20. The dust collector of claim 13, wherein the transmission includes:

a driven gear installed in the lower cover and exposed to a lower side of the lower cover and positioned to receive the driving force when the dust collector is installed in a vacuum cleaner; and a fastening gear coupled to the driven gear and exposed to an upper side of the lower cover, and extending to engage an inner circumferential surface of the rotating case when the lower cover is coupled to the external case to transfer the driving force from the driven gear to the rotating case.

* * * * *